US005641115A

United States Patent [19]

Brewster

[11] Patent Number: 5,641,115

[45] Date of Patent: Jun. 24, 1997

[54] COMBINATION GREETING CARD AND ENVELOPE

[76] Inventor: Lois V. Brewster, 1053 Masselin Ave., Los Angeles, Calif. 90019

[21] Appl. No.: 324,013

[22] Filed: Oct. 14, 1994

Related U.S. Application Data

[63] Continuation-in-part of Ser. No. 283,076, Jul. 29, 1994, abandoned.

[51] Int. Cl.[6] ..... B65D 27/22

[52] U.S. Cl. ..... 229/92.8; 229/75; 229/84; 229/92.7

[58] Field of Search ..... 40/158.1, 152.1; 229/84, 75, 92.8, 92.1, 92.7

[56] References Cited

U.S. PATENT DOCUMENTS

| | | | |
|---|---|---|---|
| 43,126 | 6/1864 | Murphy | 229/92.7 |
| 1,396,724 | 11/1921 | Cameron | 40/152.1 |
| 1,421,097 | 6/1922 | Pente | 229/92.3 |
| 1,602,583 | 10/1926 | Lawrence | 40/152.1 |
| 1,632,185 | 6/1927 | Jenner | 229/92.8 |
| 2,137,516 | 11/1938 | West | 229/92.7 |
| 2,219,492 | 10/1940 | Prichap | 229/92.8 |
| 2,538,894 | 1/1951 | Bender | 40/158.1 |
| 2,782,542 | 2/1957 | Blevens | 40/152.1 |
| 2,881,662 | 4/1959 | Harris | 229/92.8 |
| 3,174,244 | 3/1965 | Walton | 40/158.1 |
| 4,167,241 | 9/1979 | Zumbrunn | 40/152.1 |
| 4,186,868 | 2/1980 | Coleman | 229/92.1 |
| 4,640,030 | 2/1987 | Woud et al. | 40/158.1 |
| 4,780,975 | 11/1988 | Friedman | 40/158.1 |
| 5,337,949 | 8/1994 | Seeley | 40/158.1 |

FOREIGN PATENT DOCUMENTS

| | | | |
|---|---|---|---|
| 18577 | of 1903 | United Kingdom | 229/92.1 |

*Primary Examiner*—Stephen P. Garbe

[57] ABSTRACT

A combination greeting card and envelope formed from a unitary sheet of material. The combination greeting card and envelope has a main card panel with a front face and a rear face, a pair of side doors, one each extending from side edges of the main card panel, with the pair of side doors being sized to generally overlay at least a portion of the front and rear faces of the main card panel. A closure panel having a front and back side extends from a top edge of the main card panel, with the closure panel being sized to be overlayable of the main card panel. A retention flap extends from a top edge of the closure panel. In use, the combination greeting card and envelope is designed to be folded for display on a retail rack, folded for mailing, and folded for display by the end user.

2 Claims, 2 Drawing Sheets

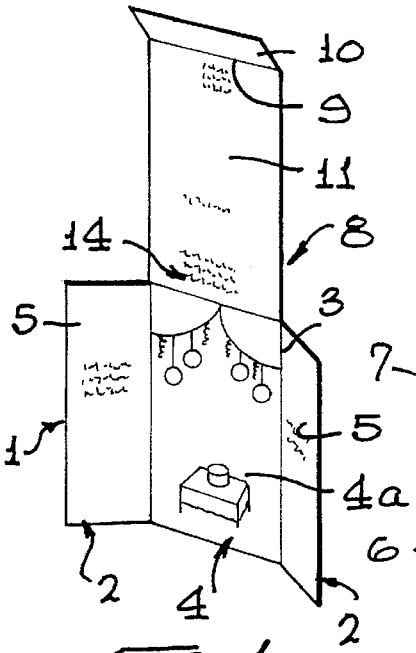
FIG. 1
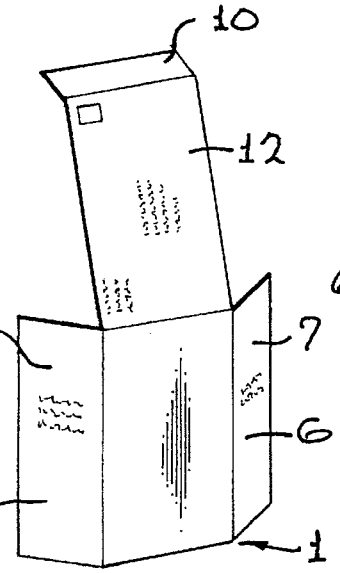
FIG. 2
FIG. 3
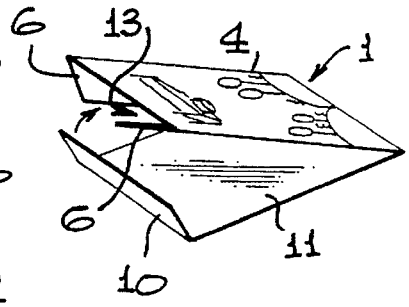
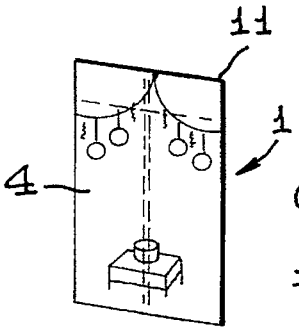
FIG. 4
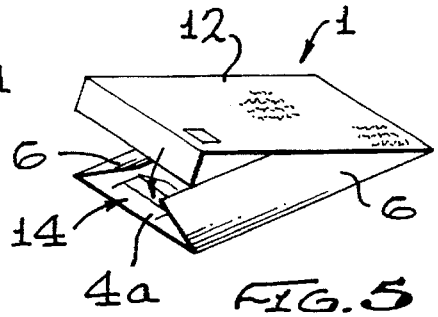
FIG. 5
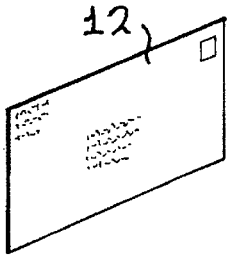
FIG. 6
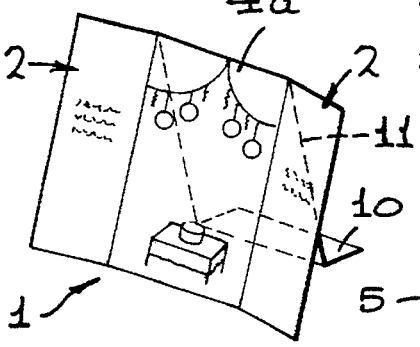
FIG. 7
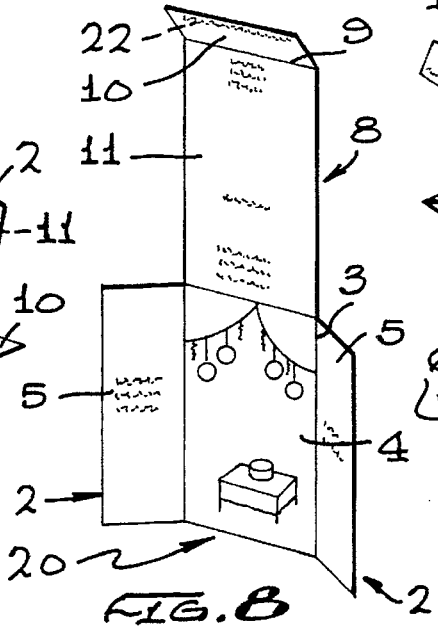
FIG. 8
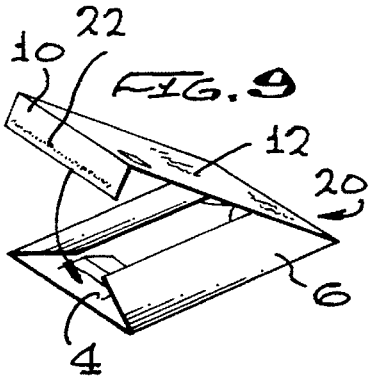
FIG. 9
FIG. 10
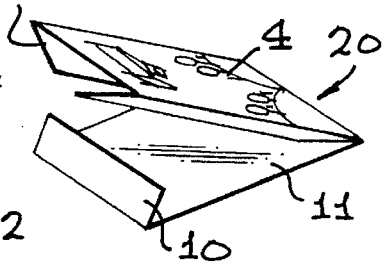

FIG. 11
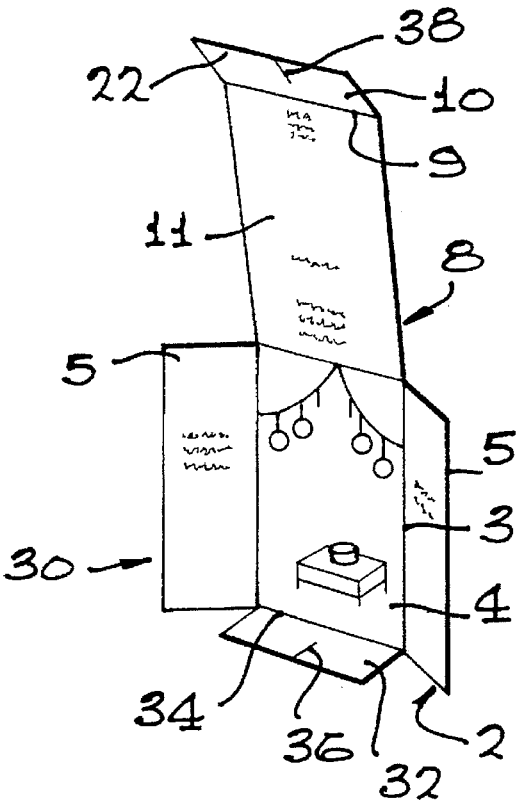
FIG. 12
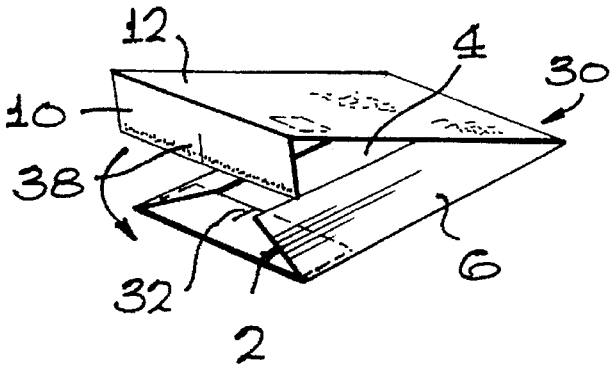
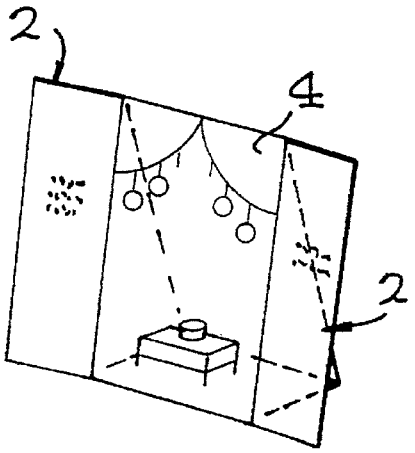
FIG. 14
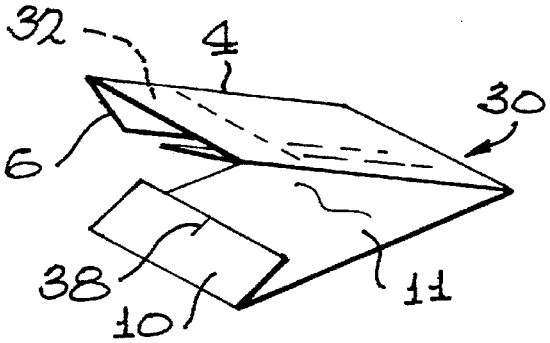
FIG. 13

COMBINATION GREETING CARD AND ENVELOPE

CROSS REFERENCE TO RELATED APPLICATIONS

This application is a continuation-in-part of U.S. patent application Ser. No. 08/283,076, filed Jul. 29, 1994, now abandoned.

BACKGROUND OF THE INVENTION

1. Field of the Invention

This invention relates to the field of greeting cards, and more particularly to a combination greeting card and envelope which is made from a single sheet of paper, i.e. card stock, and which can be folded to display the face of the card, and folded into the form of an envelope for mailing.

2. Description of the Prior Art

Greeting cards, announcement cards, holiday cards and the like are widely exchanged among people of all the world. Billions of these cards are printed and sold in the United States alone each year. Most cards are provided with a separate envelope. The envelope is most often immediately thrown away, with the card being saved, or also thrown away at a latter date. The result is a tremendous volume of paper being manufactured and thrown away, which contributes to the solid waste disposal problem.

In the past, others have attempted to create combination mailing cards and envelopes. U.S. Pat. No. 5,135,157 to Cruz discloses a combination greeting card and envelope which uses adhesive materials and tear off strips and a closure flap to permit the greeting card to be closed up. The closure flap and tear off strips are removed upon receipt. However, the mailing address side of the card is still visible in this card. U.S. Pat. No. 4,780,975 to Friedman teaches a combined mailer and easel-type display frame. The Friedman card does not provide a way to display the card in a flat states, i.e. to be displayed for retail sale. U.S. Pat. No. 1,632,185 to Jenner discloses a tripartite mailing card with three folding panels, which when folded into one embodiment provides an envelope, and when folded in a second embodiment reveals the greeting card side of the card. The card of Jenner does not provide a hinging front door. U.S. Pat. No. 1,347,269 to Greble, U.S. Pat. No. 2,148,279 to Sandberg, U.S. Pat. No. 2,203,578 to Podmore, and U.S. Pat. No. 5,010,669 to Moran are representative of folding postcard and envelope combinations.

Notwithstanding the earlier attempts to create a greeting card which optimally combines a greeting card and its envelope in one unitary package, made from a single sheet of paper, such as card stock or thick papers, these efforts have fallen short. There is accordingly a need for a combination greeting card and envelope made from a single sheet of paper or other material.

SUMMARY OF THE INVENTION

The invention herein provides a combination greeting card and envelope formed from a unitary sheet of material, comprising:

a main card panel with a front face and a rear face;

a pair of side doors, one each extending from side edges of said main card panel, said pair of side doors being sized to together generally be overlayable of at least a portion of the front and rear faces of the main card panel;

a closure panel extending from a top edge of the main card panel, said closure panel having a front and back side and being sized to be overlayable of the main card panel; and a retention flap extending from a top edge of the closure panel;

wherein said combination greeting card and envelope is foldable to a flat state with the front face of the main card panel and the front side of the closure panel being displayed by folding the side doors rearwardly to overlay the rear face of the main card panel, folding the closure panel rearwardly to overlay the pair of side doors, and tucking the retention flap into a space created by the folded back side doors and the rear face of the main card panel, and wherein said combination greeting card and envelope is foldable into a mailing envelope orientation, with the back face of the main card panel and the back side of the closure panel being exposed, by folding the side doors forwardly to overlay the front face of the main card panel, folding the closure panel frontwardly to overlay the pair of side doors, and tucking the retention flap into a space created by the folded back side doors and the front face of the main card panel, and wherein said combination greeting card and envelope is foldable to an open state by swinging the side doors outwardly and folding the closure panel rearwardly to reveal the front face of the main card panel.

The invention herein further provides a combination greeting card and envelope formed from a unitary sheet of material, comprising:

a main card panel with a front face and a rear face;

a pair of side doors, one each extending from side edges of said main card panel, said pair of side doors being sized to together generally be overlayable of at least a portion of the front and rear faces of the main card panel;

a closure panel extending from a top edge of the main card panel, said closure panel having a front and back side and being sized to be overlayable of the main card panel; and a retention flap extending from a top edge of the closure panel;

wherein said combination greeting card and envelope is foldable to a flat state with the front face of the main card panel and the front side of the closure panel being displayed by folding the side doors rearwardly to overlay the rear face of the main card panel, folding the closure panel rearwardly to overlay the pair of side doors, and by one of (a) folding the retention flap inwardly to overlay the pair of side doors and (b) tucking the retention flap into the space created between the pair of side doors and rear face of the main card panel, and wherein said combination greeting card and envelope is foldable to a flat, envelope orientation for mailing purposes, with the back face of main card panel and the back side of the closure panel being displayed, by folding the side doors forwardly to overlay the front face of the main card panel, folding the closure panel frontwardly to overlay the pair of side doors, and by one of (a) attaching the retention flap by attachment means to the back face of the main card panel and (b) tucking the retention flap into a space created by the folded back side doors and the front face of the main card panel, and wherein said combination greeting card and envelope is foldable to an open state by swinging the side doors outwardly to uncover the front face of the main card panel and by folding the closure panel rearwardly.

The invention herein yet further provides a combination greeting card and envelope formed from a unitary sheet of material, comprising:

a main card panel with a front face and a rear face;

a pair of side doors, one each extending from side edges of said main card panel, said pair of side doors being sized to together generally be overlayable of at least a portion of the front and rear faces of the main card panel;

a closure panel extending from a top edge of the main card panel, said closure panel having a front and back side and being sized to be overlayable of the main card panel;

a retention flap extending from a top edge of the closure panel; and a stand flap extending from a bottom edge of the main card panel;

wherein said combination greeting card and envelope is foldable to a flat state with the front face of the main card panel and the front side of the closure panel being displayed by folding the side doors rearwardly to overlay the rear face of the main card panel, folding the closure panel rearwardly to overlay the pair of side doors, folding the stand flap rearwardly, and by one of (a) folding the retention flap inwardly to overlay the pair of side doors and (b) tucking the retention flap into the space created between the pair of side doors and rear face of the main card panel, and wherein said combination greeting card and envelope is foldable to a flat, envelope orientation for mailing purposes, with the back face of main card panel and the back side of the closure panel being displayed, by folding the side doors forwardly to overlay the front face of the main card panel, folding the stand flap forwardly, folding the closure panel frontwardly to overlay the pair of side doors, and by one of (a) attaching the retention flat by attachment means to the back face of the main card panel and (b) tucking the retention flap into a space created by the folded back side doors and the front face of the main card panel, and wherein said combination greeting card and envelope is foldable to an open state by swinging the side doors outwardly to uncover the front face of the main card panel, by folding the closure panel rearwardly, folding the retention flap towards the main card panel, and by folding the stand flap rearwardly and engaging it with the retention flap.

BRIEF DESCRIPTION OF THE DRAWINGS

The invention is described below in greater detail with reference to the drawings.

FIG. 1 is a front perspective view of a first embodiment of the combination greeting card and envelope of the invention, in a spread open state.

FIG. 2 is a rear perspective view of the combination greeting card and envelope of FIG. 1 in a spread open state.

FIG. 3 is a perspective view of the combination greeting card and envelope of FIG. 1 being folded into its form with its side doors concealed for retail display.

FIG. 4 is a top view of the combination greeting card and envelope of FIG. 1 which has been completely folded into its retail display orientation.

FIG. 5 is a perspective view of the combination greeting card and envelope of FIG. 1 being folded into its envelope form.

FIG. 6 is a top view of the combination greeting card and envelope of FIG. 1 which has been completely folded into its envelope form.

FIG. 7 is a front perspective view of the combination greeting card and envelope of FIG. 1 with its side doors open to reveal the front face of the card.

FIG. 8 is a front perspective view of a second embodiment of the combination greeting card and envelope of the invention, in an unfolded open state.

FIG. 9 is a perspective view of the combination greeting card and envelope of FIG. 8 being folded into its envelope form.

FIG. 10 is a perspective view of the combination greeting card and envelope of FIG. 8 being folded into its form with its side doors concealed for retail display.

FIG. 11 is a front perspective view of a third embodiment of the combination greeting card and envelope of the invention, in an unfolded open state.

FIG. 12 is a perspective view of the combination greeting card and envelope of FIG. 11 being folded into its envelope form.

FIG. 13 is a perspective view of the combination greeting card and envelope of FIG. 11 being folded into its form with its side doors and stand flap concealed for retail display.

FIG. 14 is a front perspective view of the combination greeting card and envelope of FIG. 11, with its side doors open and retention and stand flaps engaged to provide a stand to reveal the front face and open side doors of the card.

DETAILED DESCRIPTION OF THE INVENTION

Referring to FIGS. 1 and 2, a first embodiment of the combination gift card and envelope 1 of the invention has two folding side doors 2 extending from side edges 3 of a main card panel 4. The combination gift card and envelope 1 typically has art work and/or text or objects attached to its face, on the front side 4*a* of the main card panel 4. The side doors 2 normally would also have text and/or designs on their inside faces 5. The outside faces 6 of the side doors 2, when folded to overlay the main card panel 4, can also have design and/or text 7 printed thereon, and even other objects, such as paper mache, origami, and the like. Hereinafter, these are sometimes referred to as "design indicia." A closure panel 8 extends from the top edge of the main card panel 4. A retention flap 10 extends from the top edge 9 of the closure panel 8. The front side 11 of the closure panel 8 preferably has printed thereon written indicia 14 such as its greeting, its designer, folding instruction, price, etc., much as conventional cards do. The rear side 12 of the closure panel 8 has the appearance of the front of a postcard, viz., for example, it can have a place for the addressor, the addressee, and the stamp.

Referring to FIGS. 3 and 4, for purposes of display of the combination greeting card and envelope 1 of the invention, i.e., on a display rack for selling, its side doors 2 will be folded rearwardly so as not to overlay the front face 4*a* of the main card panel 4, and closure panel 8 will be folded rearwardly to overlay the two side doors 2, and its retention flap 10 can be tucked into the space 13 thereby defined between the back of the main card panel 4 and the folded back two side doors 2. In this closed, display position, the front face 4*a* of the main card body 4 and the rear side 12 of the closure panel 8 are viewable, but the side doors 2 are tucked away, and not viewable. The combination greeting card and envelope 1 will remain in this position until changed, and can be handled without disrupting the folded card. Alternately, the retention flap 10 can simply be folded behind the side doors 6, as shown with reference to FIG. 10 of a second embodiment of the invention.

Referring to FIGS. 5 and 6, to mail the combination greeting card and envelope 1, the two side doors 2 are folded to overlay the front face 4*a* of the main card body 4, and the closure panel 8 is folded forwardly to overlay the two side doors 2 overlaying the front face 4*a* of the main card body 4. The retention flap 10 will then be tucked into the space 14 defined between the front face 4*a* of the main card body 4 and the folded back two side doors 2. Folded as such, the rear side 12 of the closure panel 8 is seen, giving the combined greeting card and envelope 1 the appearance of an envelope.

Referring to FIG. 7, to display the combination greeting card and envelope 1, the recipient of the combination greeting card and envelope will remove the folding flap 10 from the space 14 between the front face 4*a* of the main card body 4 and the folded back two side doors 2, and the two side doors 2 will be bent forward, to display their text and/or design. The retention flap 10 and closure panel 8 will thus act to provide a slant back display of the opened card. Optionally, the recipient of the combination greeting card and envelope 1 can optionally choose to tear off the closure panel 8 and retention flap 10 from the main card body 4.

Referring to FIGS. 8 to 10, a second embodiment 20 of the invention is shown. In this embodiment, attachment means 22, such as self-sticking adhesive, moisture sensitive glue, pressure sensitive glue, stickers, snaps, hook and loop material, string and button clasps, or some other conventional attachment means is placed on the retention flap 10. FIG. 8 shows the attachment means 22 being an adhesive or glue, such as conventional envelope glue which become tacky when moistened, but other attachment means would also function. All other features of this card 20 are as described with the embodiment of FIGS. 1–7.

To display the combination greeting card and envelope 20 on, for example a retail rack, the retention flap 10 is folded in back of the two rearwardly folded side doors 6, as is shown in FIG. 10.

To seal the combination greeting card and envelope 20 shut for mailing, the retention flap 10 is folded onto the rear face 4*b* of the main card panel 4, and attached thereto with the adhesive or glue 22. When the combination greeting card and envelope 20 is received in the mail, the recipient will gently detach the retention flap 10 and its adhesive or glue 22 from the rear face 4*b* of the main card panel 4, and fold it back, the same as shown with reference to FIG. 7.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A self displaying combination greeting card and envelope formed from a unitary sheet of material, comprising:

a main panel having a rectangular shape, left and right side edges, top and bottom edges, and front and rear sides, the front side of the main panel including ornamentation to be displayed;

a right side door foldably attached to the right side edge of the main panel, said door having an inside face and an outside face and being sized to be capable of overlying no more than about one-half of said main panel;

a left side door foldably attached to the left side edge of the main panel, said door having an inside face and an outside face and being sized to be capable of overlying no more than about one-half of said main panel;

a closure panel having a front side and a rear side, left and right side edges, and top and bottom edges, and being foldably attached to the top edge of the main panel, said closure panel being substantially the same size as the main panel, the closure panel left and right side edges being free of attachment to the other parts of the envelope, the rear side of the closure panel including address indicia; and a retention flap foldably attached to the top edge of the closure panel;

wherein said self displaying combination greeting card and envelope is foldable to a flat state, with the front side of the main panel being displayed, by folding the side doors to overlie the rear side of the main panel, folding the closure panel to overlie the side doors, and inserting the retention flap between the side doors and the main panel, and wherein said self displaying combination greeting card and envelope is foldable to a self displaying orientation, with the front side of the main panel being displayed and the inside surfaces of the left and right side doors being displayed, by folding the side doors into positions in which they are generally aligned with the main panel, folding the closure panel such that it extends downwardly at an angle to and adjacent the rear side of the main panel, and folding the retention panel generally horizontally in a direction away from the main panel, the closure and retention panels thereby serving as a support for maintaining the mail panel and side doors in their display positions, and wherein said self displaying combination greeting card and envelope is foldable to a flat envelope orientation for mailing purposes, with the rear side of the main panel and the rear side of the closure panel being displayed, by folding the side doors to overlie the front side of the main panel, folding the closure panel to overlie the side doors, and folding the retention flap into a position in which it secures the side doors, the main panel, and the closure panel in folded position.

2. The self displaying combination greeting card and envelope as recited in claim 1 wherein the retention flap includes adhesive for securing the side doors, the main panel, and the closure panel in folded position.

* * * * *